US006776131B2

(12) United States Patent
Dietz

(10) Patent No.: US 6,776,131 B2
(45) Date of Patent: Aug. 17, 2004

(54) INTERNAL COMBUSTION ENGINE WITH AT LEAST TWO CAMSHAFTS ARRANGED NEXT TO ONE ANOTHER AND IN EACH CASE PRODUCED WITH A DEVICE FOR ROTARY ANGLE ADJUSTMENT WITH RESPECT TO A CRANKSHAFT

(75) Inventor: Joachim Dietz, Frensdorf (DE)

(73) Assignee: Ina—Schaeffler KG (DE)

( * ) Notice: Subject to any disclaimer, the term of this patent is extended or adjusted under 35 U.S.C. 154(b) by 0 days.

(21) Appl. No.: 10/445,635

(22) Filed: May 23, 2003

(65) Prior Publication Data

US 2004/0007193 A1 Jan. 15, 2004

(30) Foreign Application Priority Data

May 25, 2002 (DE) ..... 102 23 431

(51) Int. Cl.[7] ..... F01L 1/34

(52) U.S. Cl. ..... 123/90.17; 123/90.15; 74/568 R

(58) Field of Search ..... 123/90.12, 90.15, 123/90.16, 90.17, 90.18; 74/568 R; 464/1, 2, 160; 92/121, 122

(56) References Cited

U.S. PATENT DOCUMENTS 6,035,817 A 3/2000 Uchida ..... 123/90.17
6,076,492 A * 6/2000 Takahashi ..... 123/90.17
6,289,921 B1 9/2001 Neuhaus ..... 137/454.5
6,332,439 B2 * 12/2001 Sekiya et al. ..... 123/90.17

FOREIGN PATENT DOCUMENTS

DE 197 27 180 A1 1/1999
EP 0 918 154 A2 5/1999

* cited by examiner

*Primary Examiner*—Thomas Denion
*Assistant Examiner*—Jaime Corrigan
(74) *Attorney, Agent, or Firm*—Ostrolenk, Faber, Gerb & Soffen, LLP

(57) ABSTRACT

In an internal combustion engine with two camshafts arranged next to one another and each mounted in a radial bearing in the cylinder head and hydraulic device for rotary angle adjustment of each camshaft with respect to a crankshaft. The supply and discharge of hydraulic pressure medium to and from the devices are controlled separately in each case by an electromagnetic hydraulic valve comprised of an electromagnet and of a valve housing capable of being plugged into a valve receptacle. Each valve housing on its circumference has a plurality of annular grooves with a plurality of radial orifices and on its free end face has a further orifice, via which the hydraulic valves are fluidically connected to the radial bearings of the camshafts and to a pressure connection and to a tank connection.

Valve receptacles are passage bores which are fluidically connected via horizontal transverse ducts to the radial bearings of the camshafts and to the pressure connection. The separation of individual fluid streams is caused by an adapter sleeve plugged axially onto each valve housing and having a plurality of radial bores.

6 Claims, 3 Drawing Sheets

INTERNAL COMBUSTION ENGINE WITH AT LEAST TWO CAMSHAFTS ARRANGED NEXT TO ONE ANOTHER AND IN EACH CASE PRODUCED WITH A DEVICE FOR ROTARY ANGLE ADJUSTMENT WITH RESPECT TO A CRANKSHAFT

FIELD OF THE INVENTION

The invention relates to an internal combustion engine with at least two camshafts arranged next to one another and each having a device for rotary angle adjustment with respect to a crankshaft, and it can be implemented particularly advantageously on internal combustion engines having in each case an overhead inlet and outlet camshaft.

BACKGROUND OF THE INVENTION

EP 1 046 793 A2 discloses a generic internal combustion engine with two camshafts arranged next to one another and in each case produced with a device for rotary angle adjustment with respect to a crankshaft. In that internal combustion engine, the devices for rotary angle adjustment are fastened at the drive-side ends of the two camshafts. Those ends are each mounted in a radial bearing in the cylinder head of the internal combustion engine, in principle providing hydraulic actuating drives. Within each device there are a plurality of hydraulic pressure chambers which act in relation to one another in pairs. When the chambers are acted upon alternately or simultaneously by a hydraulic pressure medium, this causes a rotary angle adjustment of the respective camshaft with respect to the crankshaft of the internal combustion engine. Supply and discharge of hydraulic pressure medium to and from the pressure chambers of each device take place in this case via the radial bearings of the camshafts and they are controlled separately by two electromagnetic hydraulic valves. Each valve consists essentially of an electromagnet and of a hollow-cylindrical valve housing connected to the latter. These valve housings can be plugged into a valve receptacle on the cylinder head of the internal combustion engine. On their circumference the housings the housings have a plurality of annular grooves which are spaced axially from one another. Into each groove are incorporated a plurality of radial orifices which issue into the interior of the valve housing. Furthermore, the valve housings are open on their free end faces, so that the hydraulic valves are fluidically connected via the annular grooves on their valve housings to the radial bearings of the camshafts and to a pressure connection and via the valve housings open on the end faces to a tank connection.

This known internal combustion engine has the disadvantage, however, that the valve receptacles for the hydraulic valves are integrated as an additional middle socket in a one-part bearing bridge produced as part of the radial bearings of the two camshafts. The pressure medium ducts are additionally arranged in a highly complicated way, for connecting the valve receptacles to the radial bearings of the two camshafts. Those ducts have to be drilled or otherwise introduced into this bearing bridge, in order to avoid overlaps of these pressure medium ducts with one another and with the pressure medium ducts, as the latter ducts are likewise arranged in a highly complicated manner in the cylinder head of the internal combustion engine, for the pressure connection and for the tank connection of the hydraulic valves. These complicated pressure medium ducts in the cylinder head of the internal combustion engine and in the bearing bridge of the camshaft radial bearings require a relatively high outlay in manufacturing terms. Together with the highly material-intensive bearing bridge, the above described ducts adversely increases the production costs for the internal combustion engine.

Other hydraulic valves having valve housings which, in a way similar to the hydraulic valve disclosed in EP 1 138 939 A1, have no annular grooves on the circumference. Instead, one-sided radial orifices are arranged offset to one another. This is admittedly a conceivable simpler arrangement of the necessary pressure medium ducts in the cylinder head and between the radial bearings of the camshafts and the valve receptacles. But, factors likewise increasing the production costs of the internal combustion engine would have to be taken into account for the necessary change in the hydraulic concept of the devices for rotary angle adjustment and for the production or procurement of the modified hydraulic valves.

OBJECT OF THE INVENTION

The object of the invention is, therefore, to provide an internal combustion engine with at least two camshafts arranged next to one another. Each camshaft has a device for rotary angle adjustment with respect to a crankshaft. The engine is designed with simple valve receptacles, which are capable of being produced cost-effectively. These receptacles are provided for the electromagnetic hydraulic valves of the device for rotary angle adjustment and, when conventional hydraulic valves with annular grooves in the valve housing are used, the receptacles make it possible to have a simplified arrangement and manufacture of the pressure medium ducts in the cylinder head and between the radial bearings of the camshafts and the valve receptacles.

SUMMARY OF THE INVENTION

The invention concerns an internal combustion engine with two camshafts arranged next to each other and also having a device for rotary angle adjustment with respect to an engine crankshaft. The object is achieved by the valve receptacles of the hydraulic valves being passage bores which are incorporated directly next to one another, and arranged vertically, into a cylinder head cover of the internal combustion engine between the camshafts. The bores have a larger diameter than the valve housings of the hydraulic valves. The bores are fluidically connected, via horizontal transverse ducts on the underside of the cylinder head cover and via vertical riser ducts in the bore walls of the valve receptacles, to the radial bearings of the camshafts and to the pressure connection of the hydraulic valves. The separation of the individual fluid streams to the hydraulic valves and to and from the radial bearings of the camshafts takes place in each case via an adapter sleeve which is plugged axially onto each valve housing. This seals off relative to one another the annular grooves in the valve housings and the riser ducts in the bore walls of the valve receptacles. The diameters of the ducts correspond in each case to the inside diameter of the valve receptacles. Each duct has a radial bore assigned to each riser duct level with the annular grooves in the valve housing in the bore walls of the valve receptacles.

In an advantageous embodiment of the internal combustion engine according to the invention, the valve housings of the hydraulic valves and the plugged-on adapter sleeves are in this case connected nonpositively to one another and are secured against rotation relative to one another preferably by a press fit between the outside diameter of the valve housings and the inside diameter of the adapter sleeves. Such securing against rotation proved necessary, since the actual pressure medium distribution of the hydraulic valves in this case takes place via the radial bores in the adapter sleeves. The radial bores are aligned exactly with the riser ducts in the bore walls of the valve receptacles. By means of a press connection between the adapter sleeves and the valve housings, in conjunction with an exactly positioned screw connection of the hydraulic valves on the cylinder head cover of the internal combustion engine, unintentional rotation of the adapter sleeves with respect to the riser ducts in the bore walls of the valve receptacles can be avoided. It would also be conceivable in this respect, however, to insert the adapter sleeves, exactly aligned by means of a press fit, into the passage bores for the valve receptacles and to fasten the hydraulic valves plugged into the adapter sleeves on the cylinder head cover of the internal combustion engine by means of a screw connection positioned in any desired way.

Instead of a nonpositive connection, in an alternative embodiment of the internal combustion engine designed according to the invention, it is also possible to connect the valve housings of the hydraulic valves and the plugged-on adapter sleeves to one another by a positive connection and, in cooperation with an exactly positioned screw connection of the hydraulic valves on the cylinder head cover of the internal combustion engine, to secure them against rotation relative to one another. In this case, it proved particularly cost-effective to connect the adapter sleeves to the valve housing by caulking the lower sleeve end face together with the lower edge portion of each valve housing. It would also be conceivable to retain the adapter sleeves on the valve housings in each case by means of a securing ring attached onto the end of the valve housings and to secure the adapter sleeves against rotation by means of a radial bore in the adapter sleeve and an inserted cylindrical pin.

A further feature of the internal combustion engine according to the invention is that the vertical transverse ducts on the underside of the cylinder head cover are made open toward the cylinder head. During the mounting of the cylinder head cover on the cylinder head, the ducts can be closed relative to one another in a fluid-tight manner by a planar cylinder head countersurface. By virtue of the valve receptacles being designed and arranged according to the invention, these transverse ducts, and also the riser ducts in the bore walls of the valve receptacles, can be designed as rectilinearly running pressure medium ducts with semicircular or angular cross sections and can thus be produced relatively simply and cost-effectively during the casting of the cylinder head cover. In this case, advantageously, at the same time the pressure connection of the hydraulic valves is arranged in the cylinder head countersurface, closing the transverse ducts. That connection is in the form of a pressure medium duct which leads to a pressure medium pump and the fluid stream of which is subdivided in the cylinder head cover, via two separate vertical transverse ducts, into two part streams and is transferred to the respective riser duct to the hydraulic valves. However, such a separation of the fluid stream of an individual pressure connection for two hydraulic valves is also possible elsewhere in the cylinder head of the internal combustion engine or may even be dispensed with completely when the two hydraulic valves are connected to separate pressure connections.

Furthermnore, in a further expedient embodiment of the internal combustion engine designed according to the invention, the planar cylinder head countersurface of the cylinder head cover is also utilized for the discharge of pressure medium from the devices for rotary angle adjustment via the hydraulic valves, in order, in this case too, to avoid a complicated arrangement and manufacture of the necessary pressure medium ducts. This takes place in that the passage bores designed in the cylinder head cover as valve receptacles are continued in the cylinder head countersurface as axially parallel outflow bores which have the same diameter as the valve receptacles and which lead to a pressure medium passage of the internal combustion engine and can likewise be produced relatively simply and cost-effectively during the casting of the cylinder head.

Finally, as the last feature of the internal combustion engine designed according to the invention, it is also proposed to make the axial length of the adapter sleeves plugged onto the valve housings of the hydraulic valves slightly greater than the depth of the passage bores for the valve receptacles in the cylinder head cover, in order to avoid adverse pressure medium leakages during the transition of the discharged pressure medium out of the hydraulic valves into the cylinder head of the internal combustion engine. What is achieved by the greater length of the adapter sleeves is that the hydraulic valves plugged into the valve receptacles project with their adapter sleeves slightly into the outflow bores in the cylinder head countersurface, so that the discharged pressure medium is transferred completely and cannot flow out in an uncontrolled manner between the cylinder head cover and the cylinder head.

Thus, the internal combustion engine designed according to the invention, with at least two camshafts arranged next to one another and in each case produced with a device for rotary angle adjustment with respect to a crankshaft, has the advantage, as compared with the internal combustion engines known from the prior art, that it has very simple valve receptacles, capable of being produced cost-effectively, for the electromagnetic hydraulic valves of the device for rotary angle adjustment in the form of passage bores incorporated directly into a cylinder head cover. By likewise very simply designed adapter sleeves being plugged onto the valve housings of the hydraulic valves, it is possible in this case both to use conventional hydraulic valves with annular grooves in the valve housing and at the same time to have a simplified arrangement and design of the pressure medium ducts for connecting the valve receptacles to the radial bearings of the camshafts in the form of transverse and riser ducts, open on one side, on the underside of the cylinder head cover and in the bore walls of the valve receptacles. At the same time, the valve receptacles in the cylinder head cover and the adapter sleeves on the valve housings allow an advantageous arrangement of the pressure and tank connections for the hydraulic valves in the cylinder head of the internal combustion engine, so that, overall, a reduction in the outlay in manufacturing terms and a lowering of the production costs of the internal combustion engine designed according to the invention are achieved.

Other features and advantages of the present invention will become apparent from the following description of the invention which refers to the accompanying drawings.

BRIEF DESCRIPTION OF THE DRAWING(S)

The invention is explained in more detail below with reference to an exemplary embodiment and is illustrated diagrammatically in the accompanying drawings in which.

DETAILED DESCRIPTION OF PREFERRED EMBODIMENTS OF THE INVENTION

Figure 1:
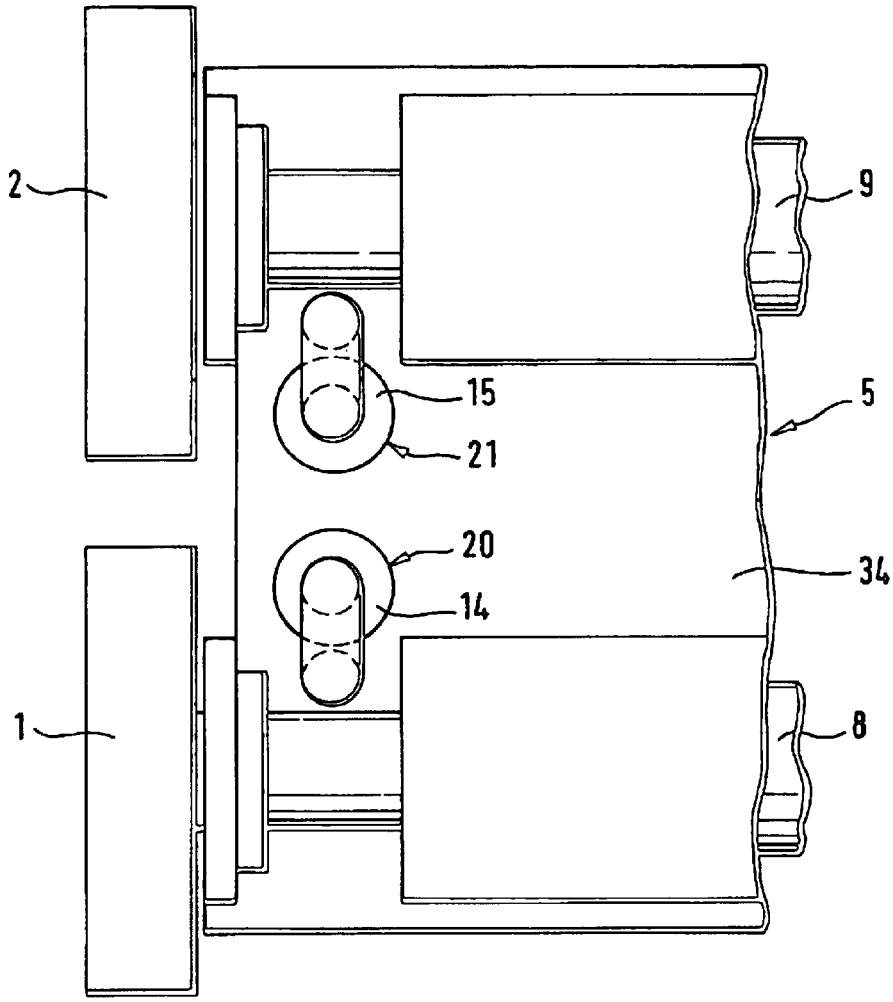
FIG. 1 shows a partial view of the top view of the cylinder head of the internal combustion engine designed according to the invention.
Figure 2:
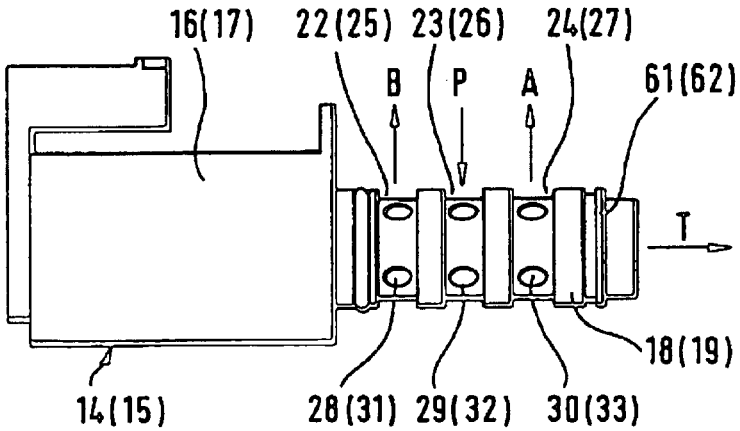
FIG. 2 shows an electromagnetic hydraulic valve for the devices for rotary angle adjustment of the camshafts of the internal combustion engine designed according to the invention.
Figure 4:
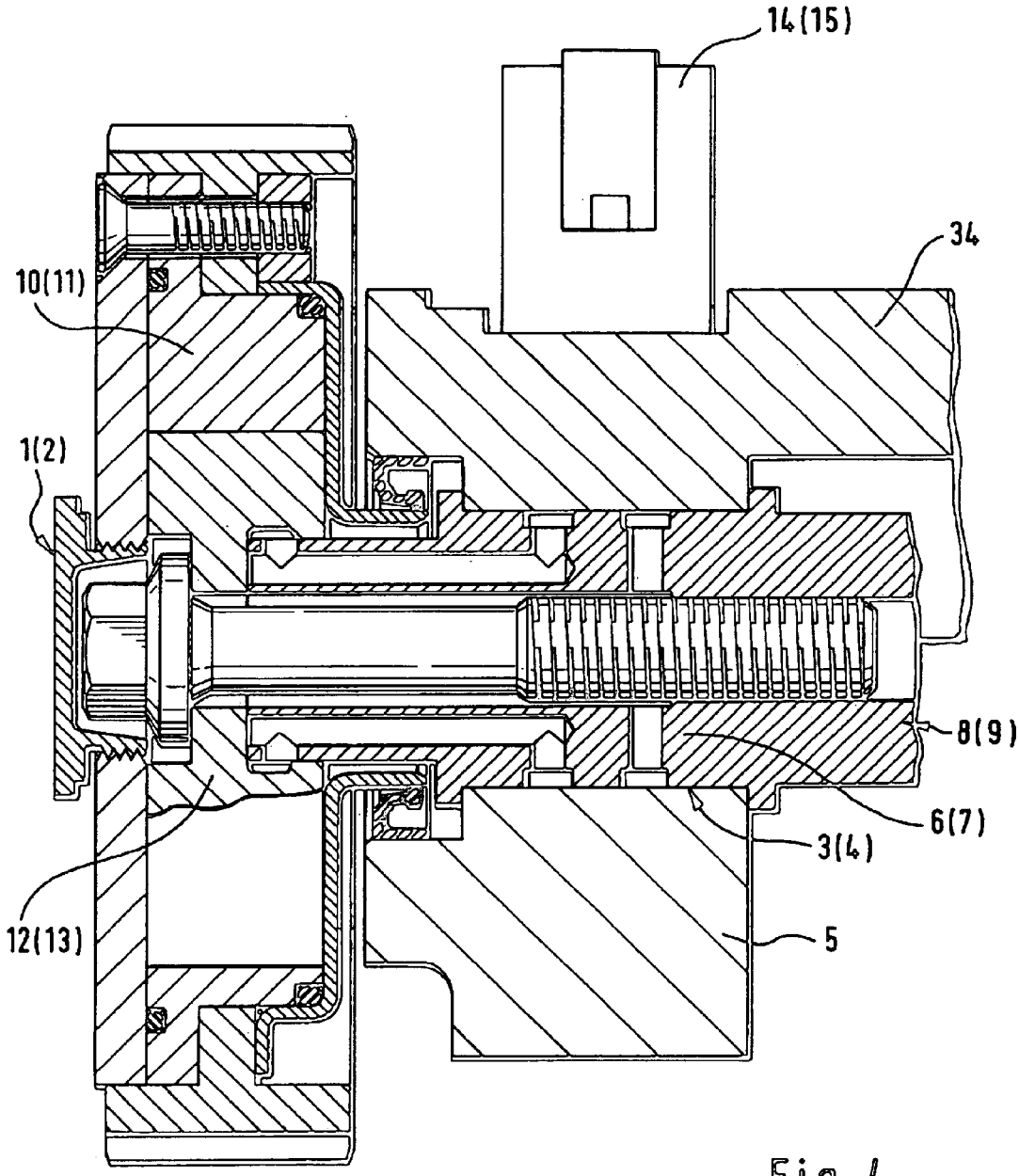
FIG. 4 shows a partial view of a longitudinal section through a device for rotary angle adjustment and through the cylinder head of the internal combustion engine designed according to the invention.

FIG. 1 shows a cylinder head 5 of an internal combustion engine with two camshafts 8, 9 which are arranged next to one another. Each camshaft has a device 1, 2 for rotary angle adjustment with respect to a crankshaft. As illustrated in FIG. 4, these devices 1, 2 for rotary angle adjustment are fastened to the drive-side ends 6, 7 of the two camshafts 8, 9. These ends are each mounted in a respective radial bearing 3, 4 in the cylinder head 5 of the internal combustion engine. Each device comprises a drive unit 10, 11 drive-connected to the crankshaft and an output unit 12, 13 connected fixedly in terms of rotation to the respective camshaft 8, 9. The devices 1, 2, are designed, in principle, as hydraulic actuating drives. At least two hydraulic pressure chambers A, B which act in relation to one another are formed in a known way between the drive unit 10, 11 and the output unit 12, 13, so that, when these pressure chambers A, B are acted upon alternately or simultaneously by a hydraulic pressure medium, there is either a relative rotation or hydraulic clamping of the output unit 12, 13 with respect to the drive unit 10, 11 and, consequently, either rotary angle adjustment or fixing respectively of the camshaft 8, 9 with respect to the crankshaft of the internal combustion engine. The supply and discharge of the hydraulic pressure medium to and from the pressure chambers A, B of each device 1, 2 in this case take place, as can likewise be seen clearly in FIG. 4, via the radial bearings 3, 4 of the camshafts 8, 9. Supply and discharge are controlled separately by two electromagnetic hydraulic valves 14, 15 which can be plugged in each case in a valve receptacle 20, 21, merely indicated in FIGS. 1 and 5, on the cylinder head 5 of the internal combustion engine. FIG. 2 shows, in this case, that the hydraulic valves 14, 15 each comprise an electromagnet 16, 17 and a hollow-cylindrical valve housing 18, 19 which is connected to the electromagnet. The circumference of the electromagnet has three annular grooves 22, 23, 24 and 25, 26, 27 which are spaced axially from one another. Each groove has incorporated in it a plurality of radial orifices 28, 29, 30 and 31, 32, 33 that issue into the valve housing 18, 19. FIG. 2 indicates, furthermore, that the valve housings 18, 19 of the hydraulic valves 14, 15 are open on their free end faces, so that each hydraulic valve 14, 15 is fluidically connected via the annular grooves 22, 23, 24 and 25, 26, 27 in its valve housing 18, 19, on the one hand, to the radial bearing 3, 4 of the respective camshaft 8, 9 or to the pressure chambers A, B of the respective device 1, 2 and, on the other hand, to a pressure connection P, while the valve housing 18, 19 open on the end face is designed as a tank connection T leading to a pressure medium reservoir of the internal combustion engine.

Figure 5:
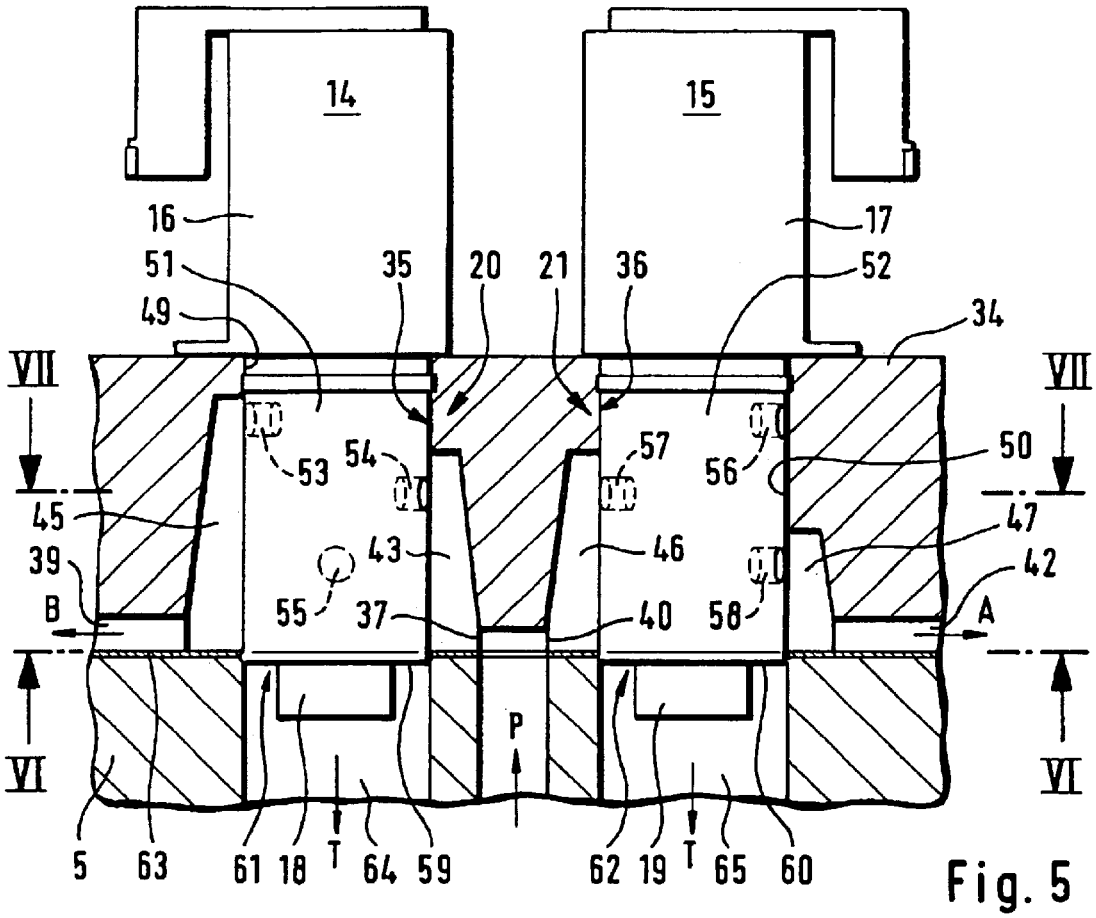
FIG. 5 shows a cross section A—A according to FIG. 6 through part of the cylinder head of the internal combustion engine designed according to the invention.
Figure 6:
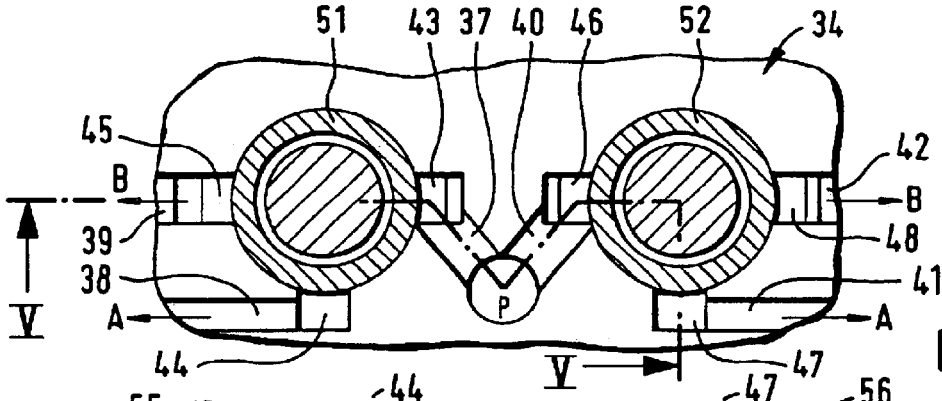
FIG. 6 shows a cross section B—B according to FIG. 5 through part of the cylinder head of the internal combustion engine designed according to the invention.
Figure 7:
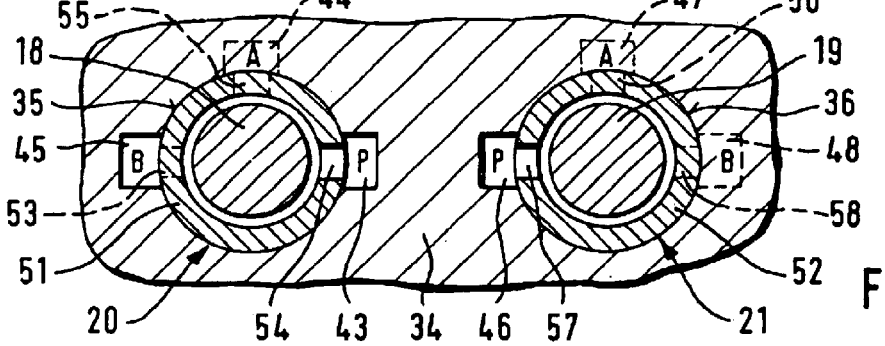
FIG. 7 shows a cross section C—C according to FIG. 5 through part of the cylinder head of the internal combustion engine designed according to the invention.

It is clearly evident from FIG. 5, further, that, in order to lower the manufacturing costs and to avoid pressure medium ducts, arranged in a complicated manner, leading to and from the hydraulic valves 14, 15, the valve receptacles 20, 21 of the hydraulic valves 14, 15 are designed, according to the invention, as passage bores 35, 36 which are incorporated directly next to one another, vertically, into a cylinder head cover 34 of the internal combustion engine between the camshafts 8, 9. Those passage bores have a larger diameter than the valve housings 18, 19 of the hydraulic valves 14, 15. FIGS. 6 and 7 illustrates that the valve receptacles 20, 21 are fluidically connected, via rectilinearly running horizontal transverse ducts 37, 38, 39 and 40, 41, 42 on the underside of the cylinder head cover 34 and via straight vertical riser ducts 43, 44, 45 and 46, 47, 48 in the bore walls 49, 50 of the passage bores 35, 36, to the radial bearings 3, 4 of the camshafts 8, 9 and to the pressure connection P of the hydraulic valves 14, 15.

Figure 3:
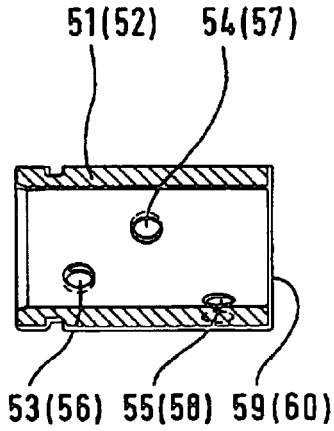
FIG. 3 shows an adapter sleeve for the valve housings of the hydraulic valves of the devices for rotary angle adjustment of the camshafts.

The separation of the individual fluid streams to the hydraulic valves 14, 15 and to and from the radial bearings 3, 4 of the camshafts 8, 9 takes place in each case via an axially plugged-on adapter sleeve 51, 52, illustrated as an individual part in FIG. 3 and in the installation position in FIG. 5. The sleeve seals off relative to one another the annular grooves 22, 23, 24 and 25, 26, 27 in the valve housings 18, 19 and the riser ducts 43, 44, 45 and 46, 47, 48 in the bore walls 49, 50. The sleeve has an outside diameter corresponding to the inside diameter of the respective valve receptacle. FIGS. 3 and 5 show that the adapter sleeves 51, 52 have positioned level with the annular grooves 22, 23, 24 and 25, 26, 27 in the valve housings 18, 19 of the hydraulic valves 14, 15, a respective radial bore 53, 54, 55 and 56, 57, 58 which is assigned to each riser duct 43, 44, 45 and 46, 47, 48 in the bore walls 49, 50 of the valve receptacles 20, 21 and via which the pressure medium distribution of the hydraulic valves 14, 15 in this case takes place.

FIGS. 3 and 5, further indicate that the valve housings 18, 19 of the hydraulic valves 14, 15 and the plugged-on adapter sleeves 51, 52 are connected positively to one another and are secured against rotation relative to one another by caulking the lower sleeve end faces 59, 60 together with the lower edge portion 61, 62 of each valve housing 18, 19. This securing against rotation makes it possible to avoid unintentional rotation of the adapter sleeves 51, 52 with respect to the riser ducts 43, 44, 45 and 46, 47, 48 in the bore walls 49, 50 of the valve receptacles 20, 21 and to align the radial bores 53, 54, 55 and 56, 57, 58 in the adapter sleeves 51, 52 with the riser ducts 43, 44, 45 and 46, 47, 48 in the bore walls 49, 50 of the valve receptacles 20, 21, with the aid of an exactly positioned screw connection of the hydraulic valves 14, 15 on the cylinder head cover 34.

FIGS. 5 and 6 show that the vertical transverse ducts 37, 38, 39 and 40, 41, 42 on the underside of the cylinder head cover 34 are open toward the cylinder head 5 and, during the mounting of the cylinder head cover 34 on the cylinder head 5, can be closed by means of a planar cylinder head countersurface 63.

The pressure connection P of the hydraulic valves 14, 15 is arranged in a clearly visible way in this cylinder head countersurface 63, in the form of an individual pressure medium duct having a fluid stream which is subdivided in the cylinder head cover 34, via the vertical transverse ducts 37, 36, into two part streams and is transferred into the riser ducts 43, 46 to the hydraulic valves 14, 15. The discharge of pressure medium from the devices 1, 2 for rotary angle adjustment via the hydraulic valves 14, 15 in this case likewise takes place via the planar cylinder head surface 34, in that the passage bores 35, 36 in the cylinder head countersurface 34, which are designed in the cylinder head cover 34 as valve receptacles 20, 21, are continued as axially parallel outflow bores 64, 65 leading to the pressure medium tank of the internal combustion engine and having the same diameter as the valve receptacles 20, 21. To avoid an uncontrolled outflow of the pressure medium between the cylinder head cover 34 and the cylinder head 5 during the transition of the discharged pressure medium out of the hydraulic valves 14, 15 into the cylinder head 5, the axial length of the adapter sleeves 51, 52 is slightly larger than the height of the passage bores 35, 36 in the cylinder head cover 34, as illustrated in FIG. 5, so that the hydraulic valves 14, 15 plugged into the valve receptacles 20, 21 project with their adapter sleeves 51, 52 into the outflow bores 64, 65 in the cylinder head countersurface 63 and the discharged pressure medium is transferred without any leakage.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An internal combustion engine including at least two camshafts arranged next to one another, each camshaft including an adjustment device for rotary angle adjustment of the camshaft with respect to a crankshaft, and further comprising:

the camshafts having drive-side ends, the adjustment devices for rotary angle adjustment are fastened to the drive-side ends of the two camshafts a respective radial bearing in the cylinder head of the internal combustion engine in which each drive-side end is mounted, the adjustment devices are hydraulic actuating drives, each adjustment device including at least two hydraulic pressure chambers which act in relation to one another such that when the pressure chambers are acted upon by a hydraulic pressure medium, it brings about a rotary angle adjustment of the respective camshaft with respect to the crankshaft, radial bearings of the camshafts cause the supply and discharge of the hydraulic pressure medium to and from the pressure chambers of each device an electromagnetic hydraulic valve controls the pressure medium separately in each case, each hydraulic valve comprises an electromagnet and a hollow-cylindrical valve housing connected to the electromagnet, a valve receptacle on the cylinder head of the internal combustion engine into which the valve housing is plugged, the valve housing of each hydraulic valve having a circumference at which a respective plurality of annular grooves are spaced axially from one another, a plurality of radial orifices incorporated in each groove and the orifices issuing into the valve housing, the annular grooves in the valve housing fluidically connecting the hydraulic valves to the radial bearings of the camshafts and to a pressure connection and via the valve housings open on end faces of the valves to a tank connection, a cylinder head cover of the internal combustion engine between the camshafts the valve receptacles of the hydraulic valves being passage bores which are incorporated directly next to one another, vertically, into the cylinder head cover and which have a larger diameter than the valve housings, horizontal transverse ducts on the underside of the cylinder head cover and vertical riser ducts in the bore walls of the valve receptacles fluidically connect the valve receptacles fluidically connect the valve receptacles to the radial bearings of the camshafts and to the pressure connection of the hydraulic valves, an adapter sleeve which is plugged axially onto each valve housing and seals off relative to one another the annular grooves in the valve housings and the riser ducts in the bore walls for separating the individual fluid streams to the hydraulic valves and to and from the radial bearings of the camshafts; the adapter sleeves having outside diameters which correspond in each case to the inside diameters of the valve receptacles each adapter sleeve having level with the annular grooves in the valve housing, respective radial bores assigned to each riser duct in the bore walls of the valve receptacles.

2. The internal combustion engine as claimed in claim 1, wherein the valve housings of the hydraulic valves and the plugged-on adapter sleeves are connected nonpositively to one another and are secured against rotation relative to one another by a press fit between the outside diameter of the valve housings and the inside diameter of the adapter sleeves.

3. The internal combustion engine as claimed in claim 1, wherein the valve housings of the hydraulic valves and the plugged-on adapter sleeves are positively connected to one another and are secured against rotation relative to one another by caulking lower sleeve end faces of the adapter sleeves together with the lower edge portions of each valve housings.

4. The internal combustion engine as claimed in claim 1, wherein the vertical transverse ducts on the underside of the cylinder head cover open toward the cylinder head and a planar cylinder head countersurface which closes the transverse ducts relative to one another in a fluid-tight manner during the mounting of the cylinder head cover on the cylinder head, the pressure connection of the hydraulic valves emerges from the countersurface.

5. The internal combustion engine as claimed in claim 4, wherein the passage bores in the cylinder head cover are valve receptacles and are continued in the cylinder head countersurface as axially parallel outflow bores, which lead to a pressure medium tank of the internal combustion engine and the passage bores have the same diameter as the valve receptacles.

6. The internal combustion engine as claimed in claim 4, wherein the axial length of the adapter sleeves is slightly greater than the height of the passage bores in the cylinder head cover, so that the hydraulic valves plugged into the valve receptacles project along with their adapter sleeves project into the outflow bores in the cylinder head countersurface.

* * * * *